US005606828A

United States Patent [19]

Hall et al.

[11] Patent Number: 5,606,828

[45] Date of Patent: Mar. 4, 1997

[54] MAGNETIC DOOR GASKET

[75] Inventors: Glenn Hall; Merl E. Brown, both of Fort Smith, Ark.

[73] Assignee: GenCorp Inc., Fairlawn, Ohio

[21] Appl. No.: 404,068

[22] Filed: Mar. 14, 1995

[51] Int. Cl.[6] ..... E06B 7/16

[52] U.S. Cl. ..... 49/490.1; 49/498.1; 49/478.1

[58] Field of Search ..... 49/478.1, 475.1, 49/490.1, 495.1, 498.1

[56] References Cited

U.S. PATENT DOCUMENTS

| | | | |
|---|---|---|---|
| 2,928,145 | 3/1960 | Foley | 20/69 |
| 3,126,590 | 3/1964 | Monti | 20/69 |
| 3,378,956 | 4/1968 | Parks et al. | 49/478.1 |
| 3,869,873 | 3/1975 | Thomas | 62/275 |
| 4,103,459 | 8/1978 | Barnerias et al. | 49/490.1 |
| 4,138,049 | 2/1979 | McAlarney | 49/478.1 X |
| 4,143,497 | 3/1979 | Offenbacher | 49/498.1 X |
| 4,583,796 | 4/1986 | Nakajima et al. | 49/478.1 X |
| 4,653,819 | 3/1987 | Swerbinsky | 49/478.1 X |
| 4,678,227 | 7/1987 | Castagno | 49/490.1 X |
| 4,700,509 | 10/1987 | Merla | 49/487 |
| 4,869,945 | 9/1989 | Harney | 49/498.1 X |

FOREIGN PATENT DOCUMENTS

| | | | |
|---|---|---|---|
| 246108 | 7/1963 | Australia | 49/478.1 |
| 707945 | 4/1965 | Canada | 62/109 |
| 1553552 | 9/1969 | Germany | 49/478.1 |
| 1416151 | 12/1975 | United Kingdom . | |

*Primary Examiner*—Kenneth J. Dorner
*Assistant Examiner*—Jerry Redman
*Attorney, Agent, or Firm*—Robert F. Rywalski; Thomas A. Meehan

[57] ABSTRACT

A magnetic door gasket (10) having a central web (18) and three enclosed chambers (12, 14, 16) projecting from a first side of the web, and a U-shaped recess (20) formed by the web and a leg (22) spaced from the opposed side of the web and joined thereto by a bight (26). The leg has a U-shaped projection (24) projecting therefrom partly to the web, the projection being spaced from the bight. The projection has a nib (28) projecting obliquely from a closed end (30) toward the web and the bight. The gasket is formed from a resilient material, such as PVC, by extrusion.

21 Claims, 1 Drawing Sheet

MAGNETIC DOOR GASKET

FIELD OF THE INVENTION

This invention relates to a gasket for sealing the perimeter of a door that is hinged to a cabinet, for example, a door of a refrigerator. More particularly, this invention relates to a gasket of the foregoing character that is adapted to a contain a permanent magnetic insert to assist in the full closing of the door and in retaining the door in its closed position.

BACKGROUND OF THE INVENTION

It is customary to provide a gasket formed from a resilient material, such as polyvinyl chloride (PVC), around the perimeter of a door to seal the juncture between a cabinet and the door when the door is hinged to the cabinet along one of the vertical sides of the door. A household refrigerator is an example of such a cabinet and door assembly. Typically, a gasket of the foregoing type has a complex configuration in cross-section, with an enclosed chamber containing a magnetic insert and one or more additional enclosed chambers that is or are yieldable under load to continuously seal the junction between the cabinet and the door, notwithstanding some variations in spacing therebetween around the perimeter of the door. A typical gasket of this type also has a generally U-shaped recess that is adapted to receive the outer edge of a panel of the door to permit the gasket to be assembled to the door.

The assembly of a door gasket to the door of a refrigerator involves frictional engagement of the gasket to the door. Because of the substantial vertical height of some doors, it is possible for a long, vertical leg of a door gasket to pull away from the edge of a door panel during assembly due to the gravitational forces acting on the gasket, thus slowing down the assembly process and/or resulting in an improperly assembled door and gasket assembly. The disengagement of the gasket from the door panel tends to be by a pivoting motion in a plane extending transversely through the gasket and the door. Examples of prior art disclosures of magnetic door gaskets include U.S. Pat. No. 4,700,509 (Merla), U.S. Pat. No. 3,869,873 (Thomas), U.S. Pat. No. 3,126,590 (Monti), and U.S. Pat. No. 2,928,145 (Foley), Canadian Patent 707,945 (issued Apr. 20, 1965) and British Patent Specification 1,416,151 (published 3 December 1975), the disclosure of each of which is incorporated by reference herein.

SUMMARY OF THE INVENTION

In accordance with the present invention there is provided a magnetic door gasket for sealing the juncture between a door and a cabinet to which the door is hinged along one of its vertical sides, for example, the door and cabinet of a typical household refrigerator. The gasket of the present invention is formed, for example, by continuous extrusion from a suitable resilient material, such as PVC. The gasket is provided with a configuration, in cross-section, in which there is an enclosed chamber for containing magnetic inserts, and one or more, preferably two, enclosed chambers which are empty and capable of deforming under load to ensure sealing of the juncture between the door and the cabinet, when the door is closed, and notwithstanding any variations in spacing between the cabinet and the door around the opposed peripheries thereof. The gasket according to the present invention is also provided with a generally U-shaped recess by which the gasket may be assembled to the exposed free edge of a door panel, and one of the legs of the U-shaped recess is provided with a generally U-shaped projection pursuant to which that leg is adapted to resiliently engage the surface of the panel of the door.

According to the present invention, the leg of a U-shaped recess that contains the U-shaped projection is provided with a nib or finger projecting therefrom obliquely toward the free edge of the door panel engaged in the recess. The nib or finger frictionally engages the door panel if and when there is a tendency for the gasket to disengage from the door, for example, under gravitational loads, which are particularly troublesome in gaskets having unusually long vertical legs. Thus, the finger or nib helps to prevent rotational motion of the gasket relative to the edge of the door panel in a plane extending transversely of the door panel, which is the typical way in which a gasket and a door panel can become inadvertently disengaged during assembly, and helps to prevent such disengagement.

Accordingly, it is an object of the present invention to provide an improved magnetic door gasket for sealing the juncture between a vertically extending door and a cabinet to which the door is hingedly attached along one of its vertical edges. More particularly, it is an object of the present invention to provide a door gasket of the foregoing character having improved resistance to disengagement, during assembly, from the door panel to which it is being assembled.

For a further understanding of the present invention and the objects thereof, attention is directed to the drawing and the following description thereof, to the detailed description of the preferred embodiment, and to the appended claims.

IN THE DRAWING

FIG. 1 is a fragmentary perspective view of a door gasket according to the preferred embodiment of the present invention shown in assembled relationship to a panel of a refrigerator door, also shown fragmentarily; and FIG. 2 is a cross-sectional view of the door gasket of FIG. 1.

DETAILED DESCRIPTION OF THE PREFERRED EMBODIMENT

Figure 2:
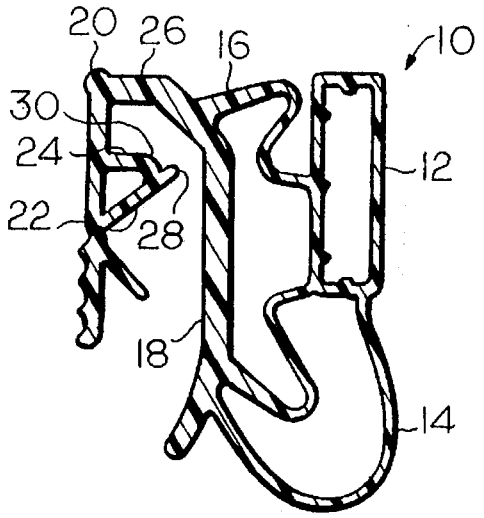
Figure 1:
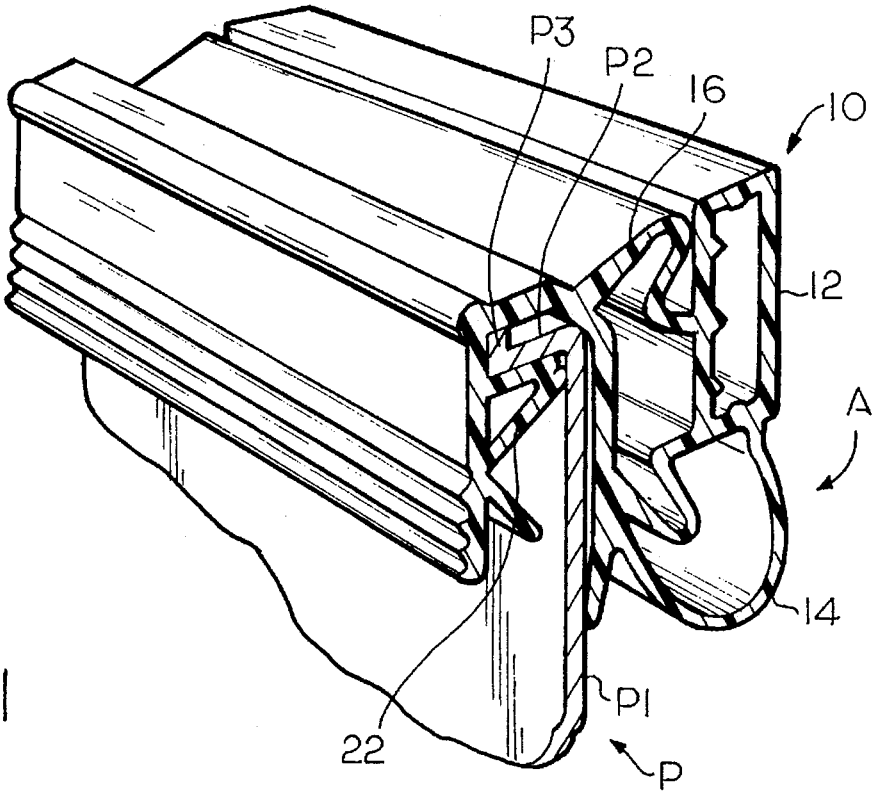

A door gasket according to the preferred embodiment of the present invention is indicated generally by reference number 10 in the drawing. Door gasket 10 is frictionally attached to a panel P of a door of a refrigerator as is shown in FIG. 1 of the drawing, and is manufactured in its illustrated complex configuration by extrusion from a suitable resilient material, such as polyvinylchloride (PVC) of a 75 Durometer (Shore A) rating. The gasket 10 is provided with a triangular array of three enclosed chambers 12, 14, 16 projecting from one side of a main central web 18, the chamber 12 being generally rectangular in configuration and being adapted to contain magnetic inserts (not shown) to assist in the closing of a door to which the door gasket is affixed and in retaining the door in its closed position. The chambers 14, 16, on the other hand, are intended to be used without any rigid inserts therein, magnetic or otherwise, and are adapted to be compressed under a load applied normally to the web 18 to ensure sealing of the juncture between the door containing the door gasket 10 and the refrigerator to which it is hinged when the door is in its closed position.

The door gasket 10 is also provided with a generally U-shaped, inwardly facing recess 20, one leg of which is the web 18, on the side opposite the locations of the chambers 12, 14, 16. The recess 20 is adapted to receive an edge of the panel P, as is shown in FIG. 1, the panel P having a main panel portion P1, a leg P2 extending normally therefrom, and a foot P3 extending normally from the leg P2 in a direction opposed to the direction of the main panel portion P1 with respect to the leg P2.

To assist in retaining the door gasket 10 in frictional engagement with the panel P, the recess 20, whose other leg is indicated by reference numeral 22, is provided with a generally U-shaped projection 24 extending partly from the leg 22 to the web 18. Thus, as is shown in FIG. 1, the leg P2 of the door panel P is trapped between the projection 24 and a bight 26 of the U-shaped recess 20 when the door gasket 10 is assembled to the panel P.

During the assembly of the door gasket 10 to a refrigerator door containing the panel P, when a substantial portion of the door gasket 10 may be oriented vertically and under the influence of gravitational forces, the door gasket 10 will tend to disengage from the door containing the panel P by movement in an arcuate plane extending generally transversely through the door panel P, as is indicated by the arrow A in FIG. 1. To prevent this disengagement, the projection 24 is provided with a finger or a nib 28 extending obliquely from a closed end 30 thereof toward the bight 26 of the recess 20. This nib 28 is adapted to frictionally engage a surface of the main panel portion P1 of the panel P, to retard such motion, and thereby serves to help prevent disengagement of the door gasket 10 from the panel P.

Although the best mode contemplated by the inventor(s) for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed:

1. A gasket for sealing a juncture between a door and a cabinet to which the door is hingedly connected, said gasket being formed from a resilient material and being adapted to be attached to a panel of the door, said gasket having a cross-sectional configuration comprising:

a central web;

a plurality of enclosed chambers extending from a first side of said central web;

a leg spaced from a second side of said central web and extending generally parallel thereto;

a bight joining an end of said leg and an end of said central web and forming a generally U-shaped recess with said leg and said web;

a generally U-shaped projection extending partly from said leg toward said web, said generally U-shaped projection being spaced from said bight and having a closed end positioned adjacent to, but spaced from, said web; and a nib extending from said closed end of said generally U-shaped projection toward said central web, said nib being adapted to impede disengagement of said gasket from the panel of the door during assembly of said gasket to the door.

2. A gasket according to claim 1 which is formed integrally by extrusion from a resilient material.

3. A gasket according to claim 2 wherein the resilient material is polyvinyl chloride.

4. A gasket according to claim 3 wherein said nib extends obliquely from said closed end toward said bight.

5. A gasket according to claim 4 wherein said plurality of enclosed chambers includes a generally rectangular chamber, said generally rectangular chamber being adapted to contain a magnetic insert.

6. A gasket according to claim 5 wherein said plurality of enclosed chambers consists of three enclosed chambers disposed in a triangular array.

7. A gasket according to claim 3 wherein said plurality of enclosed chambers includes a generally rectangular chamber, said generally rectangular chamber being adapted to contain a magnetic insert.

8. A gasket according to claim 7 wherein said plurality of enclosed chambers consists of three enclosed chambers disposed in a triangular array.

9. A gasket according to claim 2 wherein said nib extends obliquely from said closed end toward said bight.

10. A gasket according to claim 9 wherein said plurality of enclosed chambers includes a generally rectangular chamber, said generally rectangular chamber being adapted to contain a magnetic insert.

11. A gasket according to claim 10 wherein said plurality of enclosed chambers consists of three enclosed chambers disposed in a triangular array.

12. A gasket according to claim 2 wherein said plurality of enclosed chambers includes a generally rectangular chamber, said generally rectangular chamber being adapted to contain a magnetic insert.

13. A gasket according to claim 12 wherein said plurality of enclosed chambers consists of three enclosed chambers disposed in a triangular array.

14. A gasket according to claim 1 wherein said nib extends obliquely from said closed end toward said bight.

15. A gasket according to claim 14 wherein said plurality of enclosed chambers includes a generally rectangular chamber, said generally rectangular chamber being adapted to contain a magnetic insert.

16. A gasket according to claim 15 wherein said plurality of enclosed chambers consists of three enclosed chambers disposed in a triangular array.

17. A gasket according to claim 1 wherein said plurality of enclosed chambers includes a generally rectangular chamber, said generally rectangular chamber being adapted to contain a magnetic insert.

18. A gasket according to claim 17 wherein said plurality of enclosed chambers consists of three enclosed chambers disposed in a triangular array.

19. In combination with a panel of a door of a refrigerator a gasket attached to said panel for sealing a juncture between the door and a cabinet to which the door is hingedly connected, said gasket being formed from a resilient material and having a cross-sectional configuration comprising:

a central web;

a plurality of enclosed chambers extending from a first side of said central web;

a leg spaced from a second side of said central web and extending generally parallel thereto;

a bight joining an end of said leg and an end of said central web and forming a generally U-shaped recess with said leg and said web;

a generally U-shaped projection extending partly from said leg toward said web, said generally U-shaped projection being spaced from said bight and having a closed end positioned adjacent to, but spaced from, said web; and a nib extending from said closed end of said generally U-shaped projection toward said central web, said nib engaging said panel of the door during assembly of said gasket to the door to prevent disengagement of said gasket from said panel.

20. A combination according to claim 19 wherein said gasket is formed integrally by extrusion from polyvinyl chloride.

21. A combination according to claim 20 wherein said nib of said gasket extends obliquely from said closed end toward said bight.

* * * * *